US011499565B2

(12) United States Patent
Sinico et al.

(10) Patent No.: US 11,499,565 B2
(45) Date of Patent: Nov. 15, 2022

(54) IMPELLER FOR CENTRIFUGAL PUMP, PARTICULARLY FOR A RECESSED-IMPELLER PUMP, AND PUMP WITH SUCH AN IMPELLER

(71) Applicant: DAB PUMPS S.P.A., Mestrino (IT)

(72) Inventors: Francesco Sinico, Montecchio Maggiore (IT); Lorenzo Gobbi, San Martino Buon Albergo (IT)

(73) Assignee: DAB PUMPS S.P.A., Mestrino (IT)

( * ) Notice: Subject to any disclaimer, the term of this patent is extended or adjusted under 35 U.S.C. 154(b) by 61 days.

(21) Appl. No.: 17/118,917

(22) Filed: Dec. 11, 2020

(65) Prior Publication Data

US 2021/0180606 A1 Jun. 17, 2021

(30) Foreign Application Priority Data

Dec. 13, 2019 (IT) ..... 102019000023904

(51) Int. Cl.
*F04D 29/24* (2006.01)
*F04D 29/22* (2006.01)

(52) U.S. Cl.
CPC ..... *F04D 29/242* (2013.01); *F04D 29/2216* (2013.01)

(58) Field of Classification Search
CPC .. F04D 29/242; F04D 29/245; F04D 29/2216; F04D 29/2272
See application file for complete search history.

(56) References Cited

U.S. PATENT DOCUMENTS 8,439,642 B2 * 5/2013 Scott ..... F04D 7/045 415/206
9,115,589 B2 * 8/2015 Ishiguro ..... F04D 29/281
2013/0071247 A1 3/2013 Ishiguro et al.
2016/0341210 A1 11/2016 Ishikawa et al.

FOREIGN PATENT DOCUMENTS

JP 2013-213443 A 10/2013
WO 2019/073551 A1 4/2019

OTHER PUBLICATIONS

European Extended Search Report dated Apr. 23, 2021 received in European Application No. 20 20 8103.0.

* cited by examiner

*Primary Examiner* — Sabbir Hasan
(74) *Attorney, Agent, or Firm* — Scully, Scott, Murphy & Presser, P.C.

(57) ABSTRACT

An impeller for centrifugal pump comprising:
a disc,
a succession of vanes which extend from the disc around the rotation axis,
a central body, adapted for connection to a rotating shaft,
the vanes having a profile with a double curvature:
a first curvature with respect to a sectional plane that is parallel to the disc,
a second curvature with respect to a sectional plane that is perpendicular to the plane of the disc,
each one of the vanes comprising an inside curve and an outside curve with different curvatures:
the inside curve having an angle of curvature chosen between zero and one quarter of a round angle, and/or the outside curve has an angle of curvature chosen between zero and one quarter of a round angle.

11 Claims, 6 Drawing Sheets

IMPELLER FOR CENTRIFUGAL PUMP, PARTICULARLY FOR A RECESSED-IMPELLER PUMP, AND PUMP WITH SUCH AN IMPELLER

The present invention relates to an impeller for a centrifugal pump, particularly for a recessed-impeller centrifugal pump.

The invention also relates to a centrifugal pump with such an impeller.

The expression "recessed-impeller centrifugal pump" is understood to refer to a pump which has an impeller that is recessed with respect to the inlet of the intake duct and utilizes the generation of a single coherent vortex in front of the impeller to impart the centrifugal acceleration to the pumped liquid.

The impeller is constituted by a substantially flat disc from which multiple vanes, which are adapted to move a liquid, extend.

The liquid is drawn in a direction that is normal to the plane of the disc and is delivered in a direction that is radial to the latter.

The widespread use of this type of pump is due to the fact that it has a considerable capacity to pump liquid without clogging.

Generally, the vanes of the impeller are mutually equidistant, have a rectilinear or curved cross-section on the disc, and extend in height while remaining perpendicular to the disc.

The term "equidistant" in the present description is understood to mean that the corresponding points of the vanes of the impeller are at a constant mutual distance between any one vane and the next, along a circumference.

However, such pumps have some drawbacks.

During operation, end vortices form around each vane in the region in front of the impeller and can modify the trajectories of the lines of flow of the liquid, reducing both head and pumping efficiency.

In order to reduce turbulences and improve pumping efficiency, in recent years impellers have been developed which have counter-discs, arranged opposite the discs, in order to enclose the vanes between counter-discs and discs.

As an alternative to the counter-disc, impellers are commercially available in which each vane ends with a terminal portion which is parallel to the disc and is extended along the entire curvature of the vane.

Even these impellers, however, have some drawbacks.

These impellers are in fact subject to wear and to possible impacts of pumped solid bodies, in particular against counter-discs or terminal portions of the vanes, which can damage them and compromise their operation.

Recessed-impeller centrifugal pumps are also known in which the impeller has a disk that is contoured so as to follow the profile of the outer ends of the vanes or with non-equidistant vanes.

Even in these centrifugal pumps, however, end vortices form in the region in front of the impeller and can modify the trajectories of the lines of flow of the liquid, limiting head and pumping efficiency.

Finally, there are impellers in which the vanes have a profile with a double curvature, i.e.:

a first curvature with respect to a sectional plane that is parallel to the disc, with the concavity directed toward the inside of the impeller;

a second curvature with respect to a sectional plane that is perpendicular to the plane of the disc, with the concavity directed toward the outside of the impeller.

The expression "outside of the impeller", in the present description, is understood to mean that the concavity of the vanes is substantially directed toward the external circumference of the disc and/or the projection of said circumference.

The expression "inside of the impeller", in the present description, is instead understood to mean that the concavity of the vanes is substantially directed toward the internal circumference of the disc and/or the projection of said circumference.

These impellers, which can also have a counter-disc, are adapted to maximize the flow of the liquid in the intervane channel and are conceived to operate proximate to a fixed surface of the pump body.

In this manner a minimal gap is generated between the impeller and the pump body.

However, these impellers are not of the recessed type and do not generate a coherent vortex in front of the impeller.

The aim of the present invention is to provide an impeller for recessed-impeller centrifugal pump and a pump with such an impeller that are capable of improving the background art in one or more of the aspects indicated above.

Within this aim, an object of the invention is to provide an impeller for centrifugal pump, particularly for a recessed-impeller pump, which allows to improve the pumping efficiency and the head of the pump in which it is installed with respect to similar impellers of the known type.

Another object of the invention is to provide an impeller for centrifugal pump, particularly for a recessed-impeller pump, which is less subject to wear or impacts caused by solid bodies than similar impellers of the known type.

A further object of the invention is to provide an impeller for centrifugal pump, particularly for a recessed-impeller pump, in which the vortex generation capacity is maximized with respect to similar impellers of the known type.

Another object of the invention is to provide a centrifugal pump that has an impeller capable of achieving the aim and objects described above.

A still further object of the present invention is to overcome the drawbacks of the background art in a manner that is alternative to any existing solutions.

Not least object of the invention is to provide an impeller for centrifugal pump, particularly for a recessed-impeller pump, that is highly reliable, relatively easy to provide and at competitive costs.

This aim, these objects and others which will become better apparent hereinafter are achieved by an impeller for centrifugal pump comprising:

a disc, a succession of vanes which extend from said disc around a rotation axis, a central body, adapted for connection to a rotating shaft, said vanes having a profile with a double curvature:

a first curvature with respect to a sectional plane that is parallel to said disc, a second curvature with respect to a sectional plane that is perpendicular to a plane of said disc, said first curvature and said second curvature having a concavity directed toward said rotation axis, each one of said vanes comprising an inside curve and an outside curve with different curvatures:

both considering a sectional plane that is parallel to said disc, and considering a sectional plane that is perpendicular to said disc, said impeller being characterized in that:

said inside curve has an angle of curvature chosen between zero and one quarter of a round angle, and/or said outside curve has an angle of curvature chosen between zero and one quarter of a round angle.

This aim, as well as these and other objects which will become better apparent hereinafter, are also achieved by a centrifugal pump comprising such an impeller.

Further characteristics and advantages of the invention will become better apparent from the description of a preferred but not exclusive embodiment of the impeller for centrifugal pump according to the invention, illustrated by way of nonlimiting example in the accompanying drawings, wherein.

Figure 1:
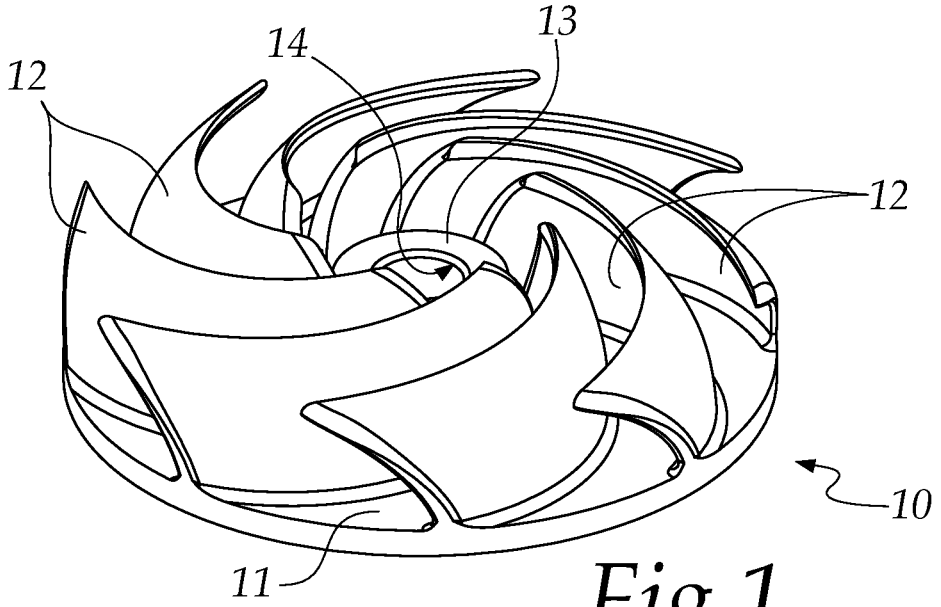
FIG. 1 is a perspective view of an impeller for centrifugal pump according to the invention.
Figure 2:
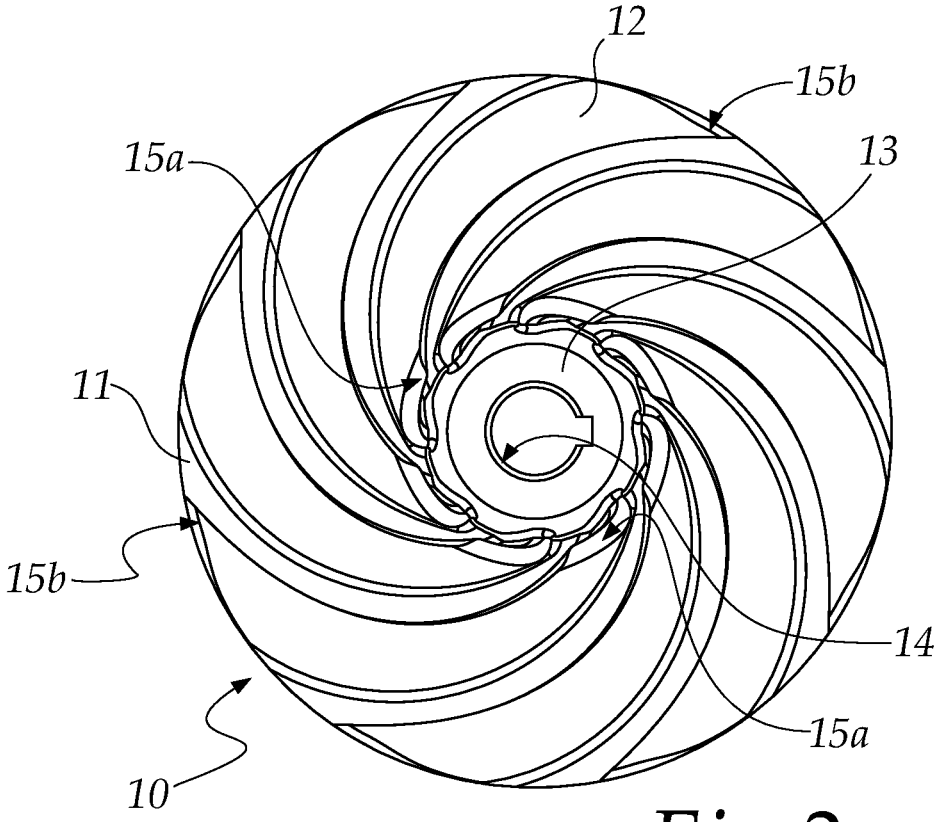
FIG. 2 is a different view of the impeller of FIG. 1.
Figure 3:
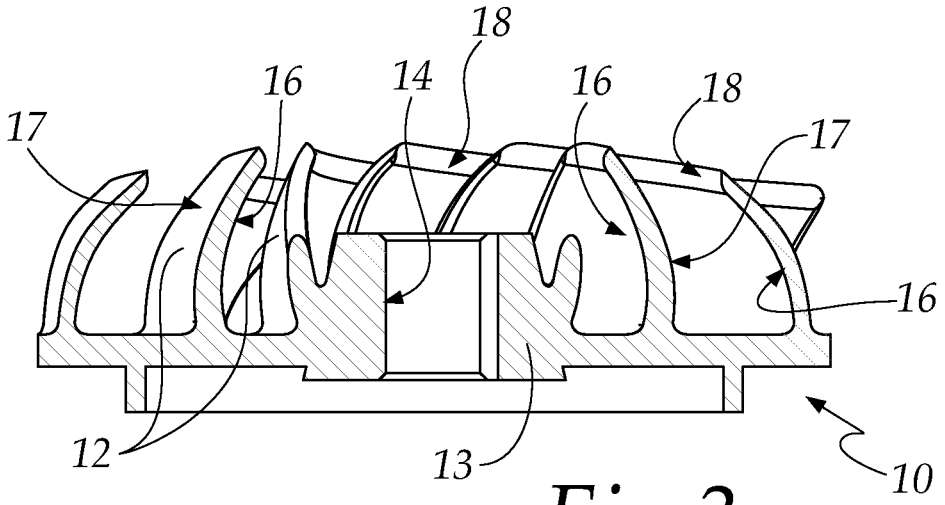
FIG. 3 is a view of a first cross-section of the impeller of FIG. 1.
Figure 4:
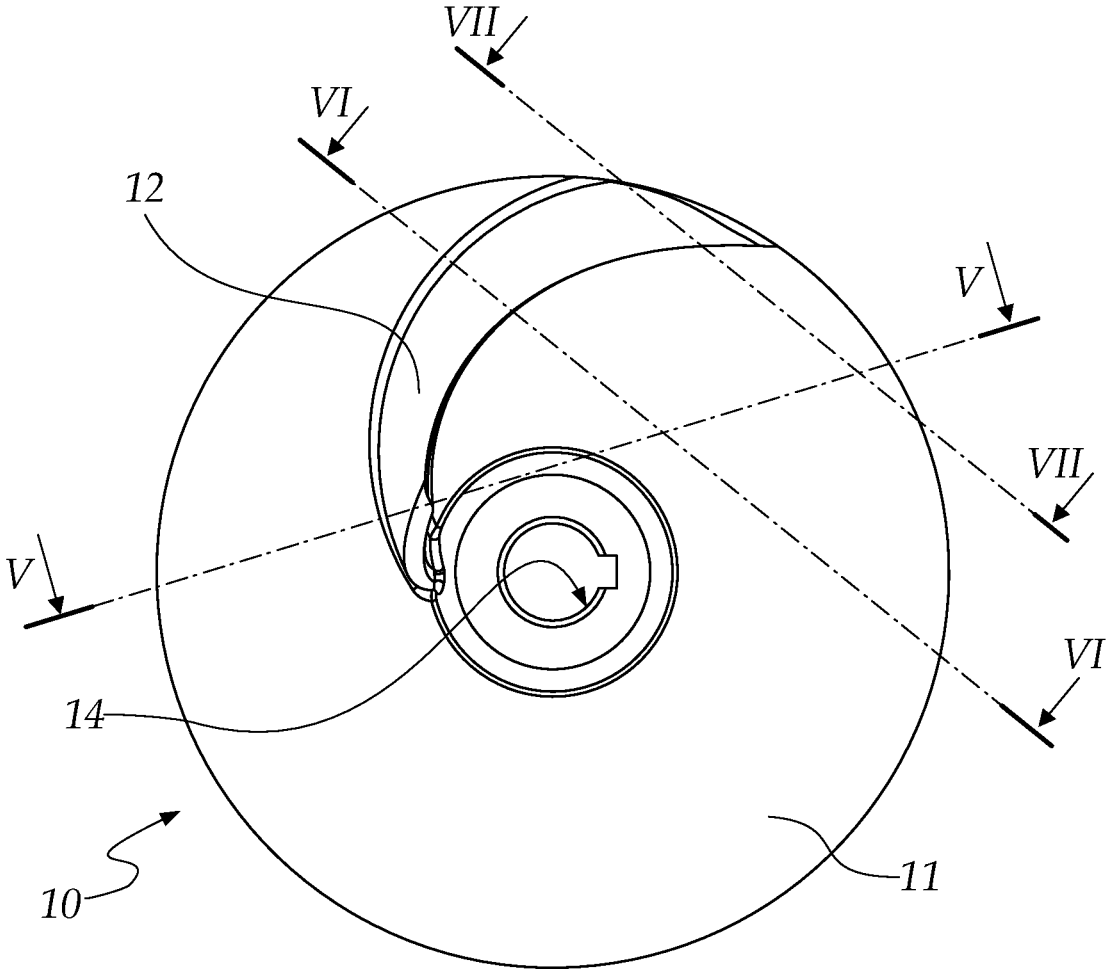
FIG. 4 is a view of an impeller for centrifugal pump according to the invention, in which a single vane is shown.
Figure 5:
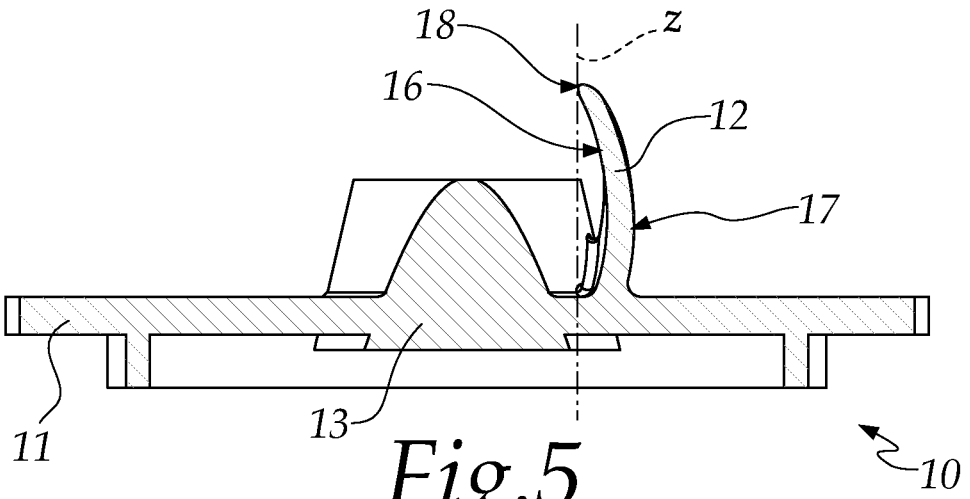
FIG. 5 is a sectional view of the impeller of FIG. 4, taken along the sectional plane V-V.
Figure 6:
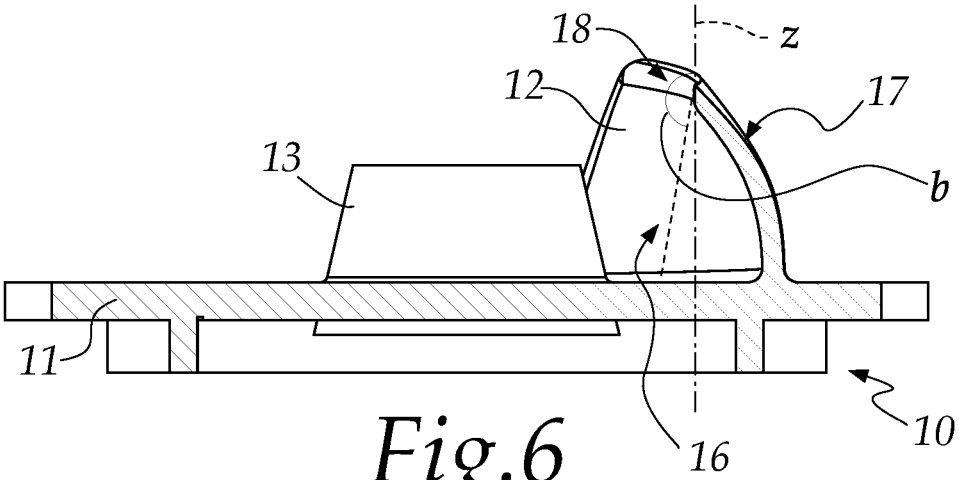
FIG. 6 is a sectional view of the impeller of FIG. 4, taken along the sectional plane VI-VI.
Figure 7:
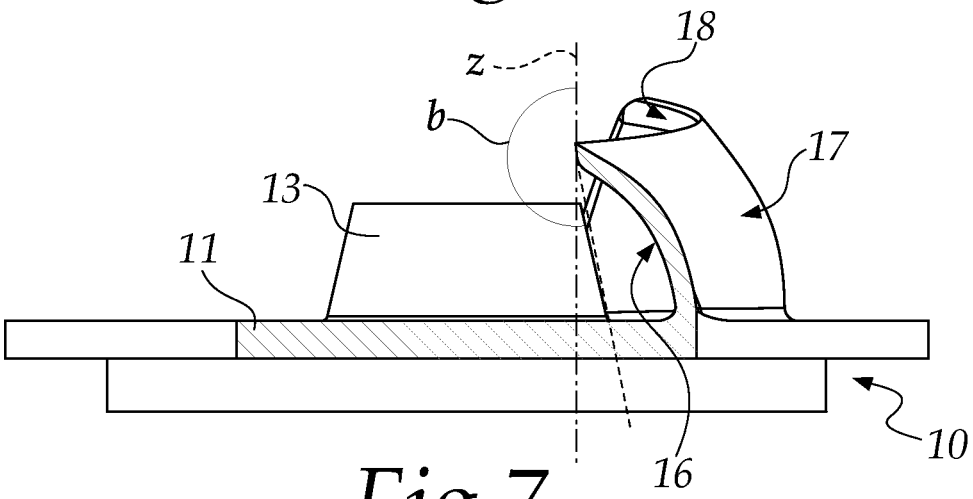
FIG. 7 is a sectional view of the impeller of FIG. 4, taken along the sectional plane VII-VII.
Figure 8A:
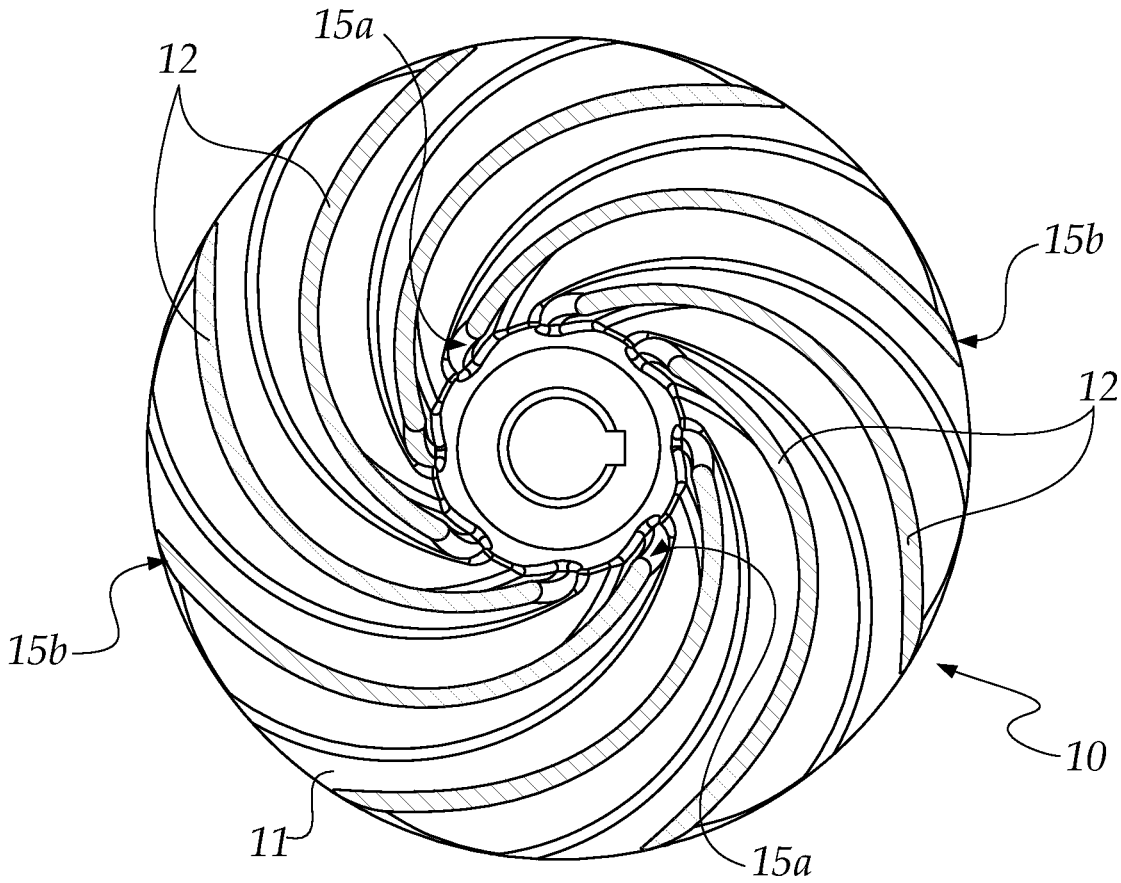
Figure 8B:
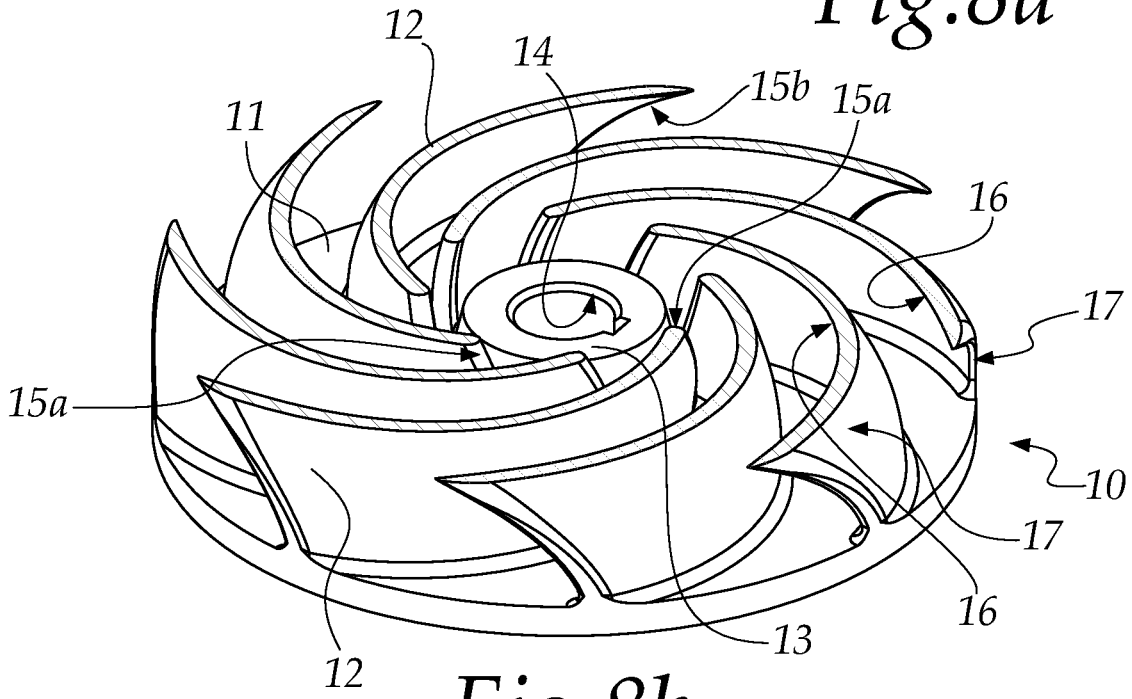
Figure 9A:
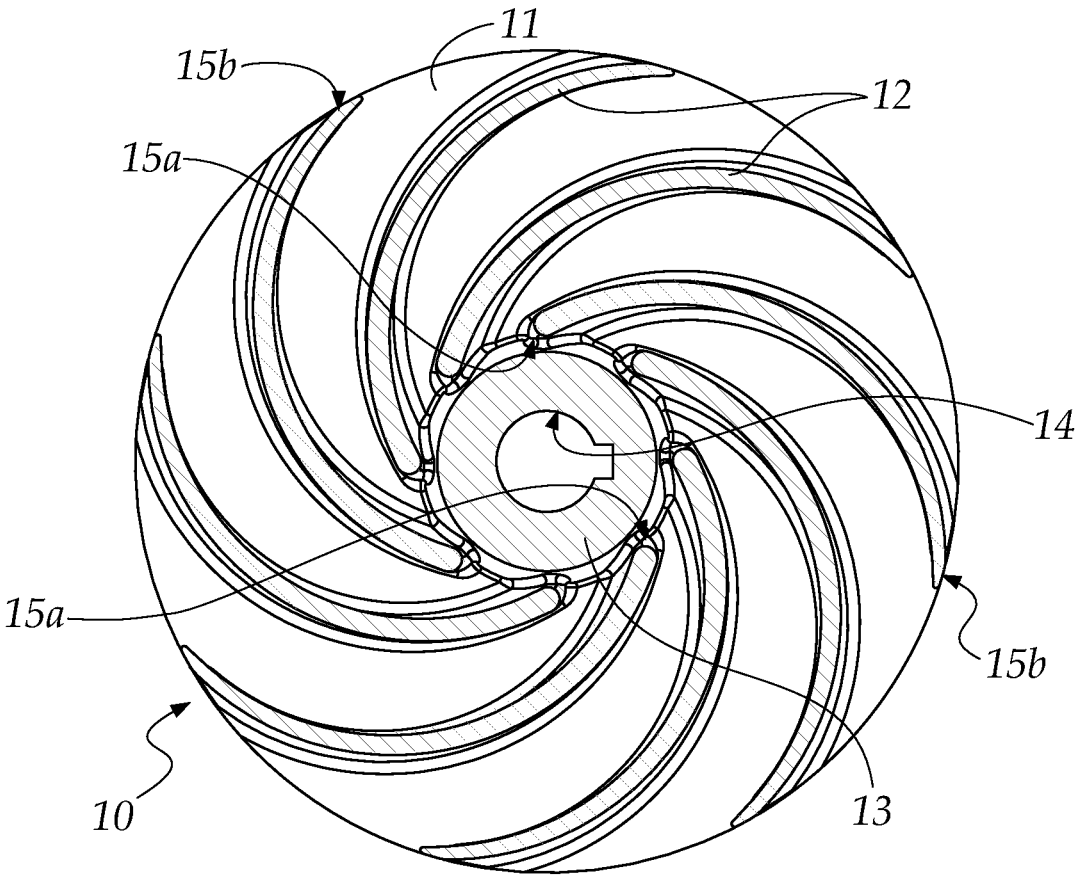
Figure 9B:
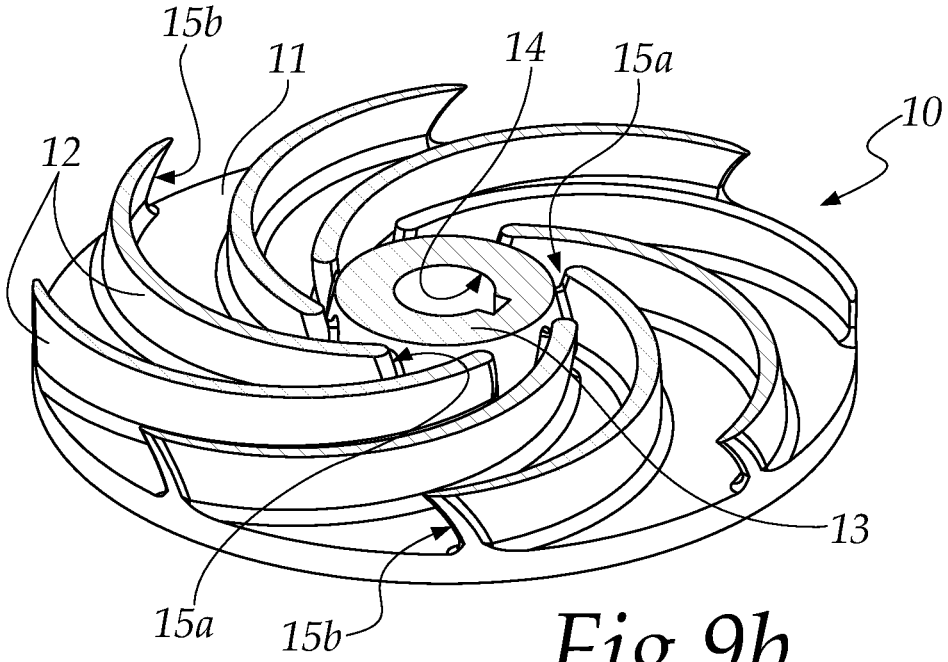
Figure 10:
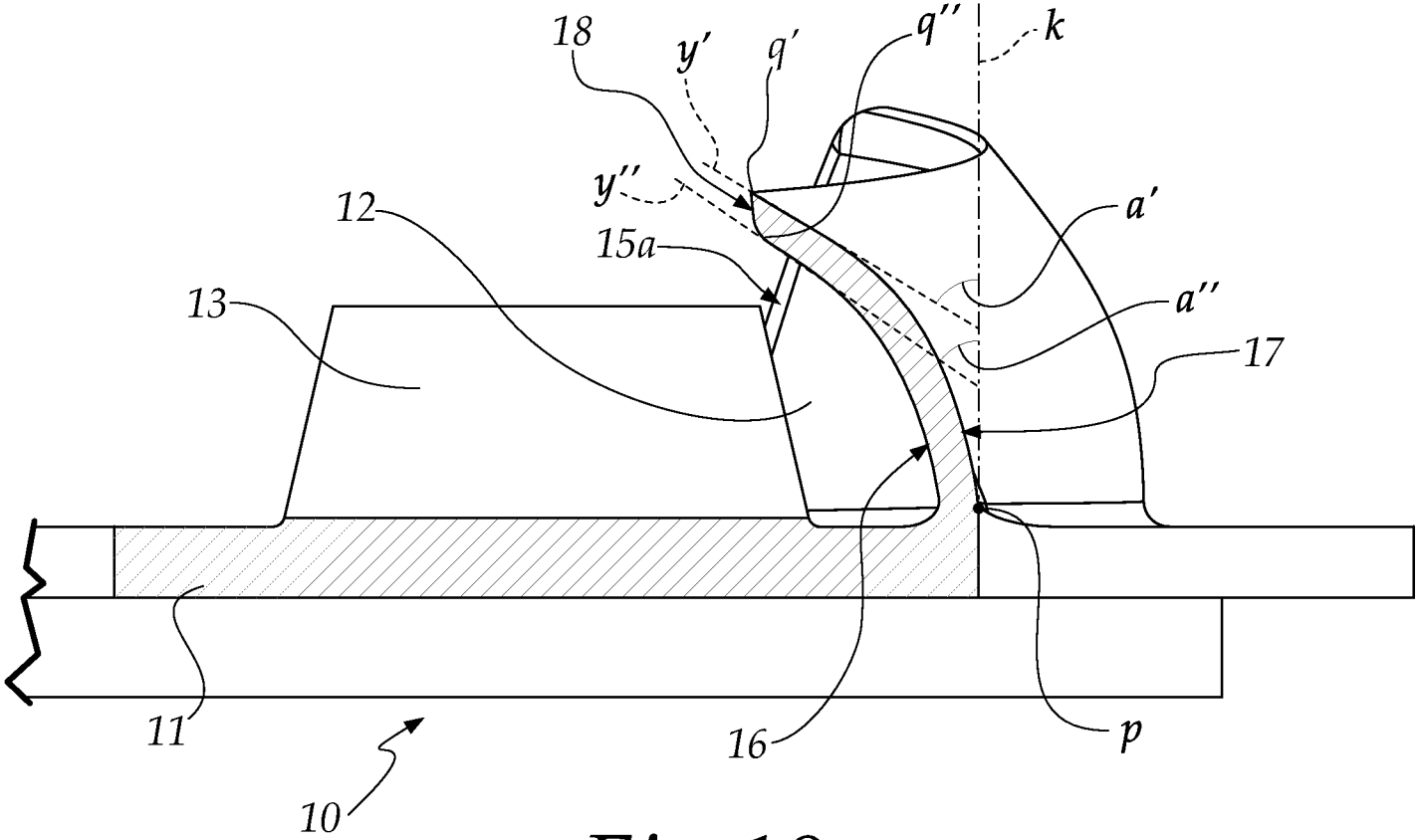

FIGS. 8*a* and 8*b* show two different views of a second cross-section of the impeller of FIG. 1;

FIGS. 9*a* and 9*b* are two different views of a third cross-section of the impeller of FIG. 1;

FIG. 10 is an enlarged-scale view of a detail of the sectional view of FIG. 7.

With reference to the figures, the impeller for centrifugal pump according to the invention, particularly but not exclusively for a recessed-impeller centrifugal pump, is designated generally by the reference numeral 10.

The impeller 10 comprises a disc 11 and a succession of vanes 12 that extends from a surface of the disc 11 around the rotation axis.

The disc 11 is substantially planar.

One of the particularities of the invention resides in that each one of the vanes 12 has a profile with a double curvature:

a first curvature with respect to a sectional plane that is parallel to the disc 11, as shown in FIGS. 8*a*-9*b;* a second curvature with respect to a sectional plane that is perpendicular to the plane of the disc 11, as shown in FIGS. 3 and 5 to 7.

In particular, both the first curvature and the second curvature have the concavity directed toward the rotation axis of the impeller 10.

The impeller 10 comprises a central body 13, at the lower circumference of the disc 11, which has a through hole 14 that is adapted for the insertion of a shaft, not shown in the figures, for its rotation.

This central body 13 has a frustum-like shape, with the larger end face substantially at the disc 11 and the smaller end face on the same side of extension as the vanes 12.

The height of the frustum of the central body 13 is lower than the height of the vanes 12.

The vanes 12 are equidistant and each vane 12 is extended between:

a first end 15*a*, located at the central body 13, and at least partially monolithic therewith, a second end 15*b*, which is arranged at the external circumference of the disc 11.

The frustum-like shape of the central body 13 facilitates the exposure of the first end 15*a* of the vanes 12 outside the influence of the central body 13. In this manner the capacity to generate the coherent vortex in front of the impeller is increased.

Another of the particularities of the invention resides in that each vane 12 comprises an inside curve 16 and an outside curve 17 which have different curvatures:

both considering a sectional plane that is parallel to the disc 11, and considering a sectional plane that is perpendicular to the disc 11.

The expression "inside curve" in the present description is understood to refer to the surface of the vane 12 that is directed toward the central body 13 and is substantially parallel to the lateral surface of the latter.

The expression "outside curve" in the present description is understood to refer to the surface of the vane 12 that is opposite the inside curve.

In particular, considering a sectional plane that is perpendicular to the disc 11, the inside curve 16 and the outside curve 17 are two arcs of circles that have distinct centers and/or two Non Uniform Rational Basis-Splines (NURBS), with a different number of poles and/or nodes.

In the present description, the expression NURBS is understood to refer to a mathematical model that is commonly used in computer graphics to generate and represent curves and surfaces and is well known to the person skilled in the art.

Considering FIG. 10, one of the particularities of the invention resides in that:

the inside curve 16 has a maximum angle of curvature a" of 90°, therefore selectively between zero and one quarter of a round angle, and/or the outside curve 17 has a maximum angle of curvature a' of 90°, therefore selectively between zero and one quarter of a round angle.

The expression "angle of curvature" in the present description is understood to refer to the angle a', a", considering a cross-section of the vane 12 on a plane that is locally perpendicular to the trajectory of extension of the vane 12 between the first end 15*a* and the second end 15*b*, which extends between:

an axis K, which is perpendicular to the plane of arrangement of the disc 11 and passes through the point p of intersection between the outside curve 17 and the disc 11 of the vane 12, a straight line Y', Y", which is tangent respectively to the inside curve 16 or to the outside curve 17 of the vane 12, in the point q' or q", that is furthest from the disc 11 along the trajectory of extension of the first curvature of the vane 12.

Another of the particularities of the invention resides in that both the inside curve 16 and the outside curve 17 have an angle of curvature a", a' that substantially increases from the first end 15*a* to the second end 15*b* of the vane 12, considering the trajectory of extension of the vane 12 between these two ends.

Preferably, the inside curve 16 has an angle of curvature a" on the order of 45°-60°.

Preferably, the outside curve 17 has an angle of curvature a' on the order of 50°-70°.

This aspect allows to increase the efficiency of the machine with respect to similar impellers of the known type, since the profile of the vane 12 can follow the pressure gradient of the pumped fluid without discontinuities.

Moreover, the power absorbed at the shaft, not shown in the figures, does not continue to rise as the flow rate of the pumped liquid increases, as in similar impellers of the known type, but for values substantially equal to or greater than 50% of the maximum flow rate its trend remains substantially constant or decreases.

This effect avoids the overheating of the motor at high flow rates (those with a value that is over 50% of the maximum flow rate).

With reference to FIGS. 5 to 7 and 9*a*, 9*b*, the thickness of each vane 12 substantially decreases uniformly from a maximum value, at the first end 15*a*, to a minimum value at the second end 15*b*.

Likewise, the thickness of each vane 12 substantially decreases uniformly from a maximum value, at the disc 11, to a minimum value at the region 18 connecting the inside curve 16 and the outside curve 17, located at the end of the vane 12 that is opposite the disc 11.

The expression "vane thickness", in the present description, is understood to refer to the distance between corresponding points of the inside curve 16 and of the outside curve 17.

Depending on the requirements, the thickness of the vane may be constant.

In particular, in the case shown in the figures, which is a non-limiting example, with variable thickness of the vane 12, the thickness at the first end 15*a* is on the order of 3-5 mm, for example 3.5 mm, while the thickness of the vane 12 at the second end 15 is on the order of 2-4 mm, for example 2.5 mm.

Likewise, the thickness of the vane 12 at the disc 11 is on the order of 3-5 mm, for example 4 mm, while the thickness at the region 18 connecting the inside curve 16 and the outside curve 17 is on the order of 2-4 mm, for example 2 mm.

The height of each vane 12 also decreases substantially, uniformly, from a maximum value, at the first end 15*a*, to a minimum value, at the second end 15*b*.

The term "height" in the present description is understood to refer to the dimension that is perpendicular to the disc 11.

In particular, the height of the vane 12 at the first end 15*a* is for example on the order of 20-40 mm, for example 29 mm, while the height of the vane 12 at the second end 15*b* is on the order of 10-30 mm, for example 20 mm.

The region 18 connecting the inside curve 16 and the outside curve 17 is extended between:

the point q" of the inside curve 16 that is furthest from the disc 11, along the trajectory of extension of the second curvature of the vane 12, considering a cross-section of the vane 12 on a plane that is locally perpendicular to the disc 11, the point q' of the outside curve 17 that is furthest from the disc 11, along the trajectory of extension of the second curvature of the vane 12, considering a cross-section of the vane 12 on a plane that is locally perpendicular to the disc 11.

The blending portion between the inside curve 16 and the connecting region 18 is rounded so as to provide a continuous surface between the two.

The blending portion between the outside curve 17 and the connecting region 18 is a sharp edge so as to provide a discontinuity of the surface between the two.

This region 18 for connection between the inside curve 16 and the outside curve 17 has a dimension, between them, that substantially increases between the first end 15*a* and the second end 15*b*.

In particular, the dimension of the connecting region 18 between the inside curve 16 and the outside curve 17 at the first end 15*a* is for example on the order of 2.5-6 mm, for example 3.2 mm, while the dimension of the connecting region 18 between the inside curve 16 and the outside curve 17 at the second end 15*b* is on the order of 1.5-4 mm, for example 2 mm.

Such region 18 for connection between the inside curve 16 and the outside curve 17 has an angle b of inclination with respect to an axis Z that is perpendicular to the disc 11 with a value that is substantially variable between the first end 15*a* and the second end 15*b*.

In particular, the inclination angle b of the connecting region 18 between the inside curve 16 and the outside curve 17 at the first end 15*a* is for example on the order of 150°-180°, for example 170°, while the inclination angle b of the region 18 for connection between the inside curve 16 and the outside curve 17 at the second end 15*b* is on the order of 180°-200°, for example 190°.

The particular shape of the vanes 12 allows to improve the pumping efficiency and the head of the pump in which it is installed with respect to similar impellers of the known type.

In order to define the curvature of the inside curve 16 and of the outside curve 17 with respect to a sectional plane that is perpendicular to the disc 11 it is possible for example:

to perform a first simulation by means of CFD (Computational Fluid Dynamics) software, setting a geometry of the vane 12 according to parameters that are known from the literature in the field and are well known to the person skilled in the art, in order to obtain an initial pressure range, to position the poles of the NURBS so that the curvatures of the inside curve 16 and of the outside curve 17 adapt as much as possible to the pressure range obtained from the first simulation, performing a simulation again, obtaining a second pressure range, positioning and/or adding poles of the NURBS so that the curvature of the inside curve 16 and of the outside curve 17 adapts as much as possible to the pressure range that has just been obtained, iterating the method until values of the pressures of the range that substantially coincide or have a difference of less than 1% are obtained in two successive simulations.

The higher the number of poles of the NURBS, the better is the shaping of the inside curve and outside curve to follow the pressure range and therefore the higher the capacity of the vane 12 to impart momentum to the pumping vortex.

It should be noted that the vanes 12, with the second curvature directed toward the inside of the impeller 10, reduce the power absorbed by the liquid, increasing the vortex generation capacity with respect to similar impellers of the known type.

In practice it has been found that the invention achieves the intended aim and objects, providing an impeller for centrifugal pump, particularly for a recessed-impeller pump, that allows to improve the pumping efficiency and head of the pump in which it is installed with respect to similar impellers of the known type.

The invention provides an impeller for centrifugal pump, particularly for a recessed-impeller pump, that is less subject to wear or to impact due to solid bodies with respect to similar impellers of the known type and in which the vortex generation capacity is maximized with respect to similar impellers of the known type.

The invention also provides a centrifugal pump that has an impeller capable of achieving the aim and objects described above.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102019000023904 from which this application claims priority are incorporated herein by reference.

What is claimed is:

1. An impeller for a centrifugal pump comprising:

a disc, a succession of vanes which extend from said disc around a rotation axis, a central body, adapted for connection to a rotating shaft, said vanes having a profile with a double curvature:

a first curvature with respect to a sectional plane that is parallel to said disc, a second curvature with respect to a sectional plane that is perpendicular to a plane of said disc, said first curvature and said second curvature having a concavity directed toward said rotation axis, each one of said vanes further comprising an inside curve and an outside curve with different curvatures:

both considering the sectional plane that is parallel to said disc, and considering the sectional plane that is perpendicular to said disc, said impeller being characterized in that:

said inside curve has an angle of curvature chosen between zero and one quarter of a first round angle, and/or said outside curve has an angle of curvature chosen between zero and one quarter of a second round angle, wherein said inside curve and said outside curve have their respective angle of curvatures increasing from said first end to said second end of each one of said vanes, considering a trajectory of extension of each one of said vanes between these the first end and the second end, and wherein said vanes are equidistant and each one of said vanes is extended between:

a first end, arranged at said central body and at least partially monolithic therewith, a second end, which is arranged at an external circumference of said disc.

2. The impeller according to claim 1, wherein a thickness of each one of said vanes decreases uniformly from a maximum value, at said first end, to a minimum value at said second end.

3. The impeller according to claim 1, wherein each one of said vanes comprises a region for connection between said inside curve and said outside curve that is located at an end of each one of said vanes that is opposite said disc.

4. The impeller according to claim 3, wherein a thickness of each one of said vanes decreases uniformly from a maximum value at said disc to a minimum value at said region for connection between said inside curve and said outside curve.

5. The impeller according to claim 3, wherein said region for connection between said inside curve and said outside curve is extended between:

a point q" of said inside curve that is furthest from said disc, along a first trajectory of extension of said second curvature of each one of said vanes, considering a cross-section of each one of said vanes on the plane that is locally perpendicular to said disc, a point q' of said outside curve that is furthest from said disc, along a second trajectory of extension of said second curvature of each one of said vanes, considering the cross-section of each one of said vanes on the plane that is locally perpendicular to said disc.

6. The impeller according to claim 3, wherein:

a blending portion between said inside curve and said region for connection is rounded so as to provide a continuous surface between the inside curve and the region for connection, and/or a blending portion between said outside curve and said region for connection is a sharp edge so as to provide a discontinuity of a continuous surface between the outside curve and the region for connection.

7. The impeller according to claim 3, wherein said region for connection between said inside curve and said outside curve has a dimension, between them, that increases between said first end and said second end.

8. The impeller according to claim 3, wherein said region for connection between said inside curve and said outside curve has an angle of inclination with respect to an axis that is perpendicular to said disc that is variable between said first end and said second end.

9. The impeller according to claim 1, wherein a height of each one of said vanes decreases uniformly from a maximum value at said first end to a minimum value at said second end.

10. The impeller according to claim 1, wherein said inside curve and said outside curve represent two arcs of circumferences with distinct centers and/or two NURBS with a different number of poles and/or nodes, considering the sectional plane that is perpendicular to said disc.

11. A centrifugal pump, comprising the impeller according to claim 1.

* * * * *